US007361090B2

(12) United States Patent
Lin

(10) Patent No.: US 7,361,090 B2
(45) Date of Patent: Apr. 22, 2008

(54) METHOD OF AUTOMATICALLY AND FAIRLY PLAYING A DIE GAME AND MACHINE FOR THE SAME

(75) Inventor: Yueh-Chun Lin, Taichung (TW)

(73) Assignee: Jumbo Technology Co., Ltd., Taichung (TW)

( * ) Notice: Subject to any disclaimer, the term of this patent is extended or adjusted under 35 U.S.C. 154(b) by 269 days.

(21) Appl. No.: 11/222,946

(22) Filed: Sep. 12, 2005

(65) Prior Publication Data

US 2007/0060301 A1 Mar. 15, 2007

(51) Int. Cl.
*A63F 9/04* (2006.01)

(52) U.S. Cl. ..... 463/22; 273/145 C; 273/145 R

(58) Field of Classification Search ..... 463/10, 463/22; 273/146, 145 A, 145 D, 145 C, 273/145 CA, 145 E, 145 R
See application file for complete search history.

(56) References Cited

U.S. PATENT DOCUMENTS

| | | | | |
|---|---|---|---|---|
| 3,831,948 | A * | 8/1974 | Suda | 273/145 R |
| 5,263,715 | A * | 11/1993 | Matsumoto et al. | 463/22 |
| 5,885,157 | A * | 3/1999 | Harada et al. | 463/22 |
| 2007/0029726 | A1* | 2/2007 | Ohira | 273/145 R |

* cited by examiner

*Primary Examiner*—Robert E. Pezzuto
*Assistant Examiner*—Masud Ahmed
(74) *Attorney, Agent, or Firm*—Bacon & Thomas PLLC

(57) ABSTRACT

A method of automatically and fairly playing a die game has acts of actuating a die game machine, shaking multiple dice by a die-shaking device in an opaque cap, recognizing pips on the dice with a detecting device, predicting numbers and placing stakes by players through player-interfaces, calculating scores of the players by a central control device, revealing the pips on the dice to the players by removing the opaque cap and showing the scores of the players on displays of the player-interfaces.

2 Claims, 5 Drawing Sheets

METHOD OF AUTOMATICALLY AND FAIRLY PLAYING A DIE GAME AND MACHINE FOR THE SAME

BACKGROUND OF THE INVENTION

1. Field of the Invention

The present invention relates to a method and a machine, and more particularly to a method of automatically and fairly playing a die game, such as a Sic-Bo game and a machine for the same.

2. Description of Related Art

Die games have been popular for thousand years and can provide interest and excitement to players. To play a die game, at least one die is thrown by multiple players in turn to determine win or lose according to pips on the topmost faces of the dice. Another way of playing a die game, multiple dice, for a Sic-Bo dice game, three dice, are held in a container with an opaque cap, and a banker shakes the container for the players to guess sum of the pips on the topmost faces of the dice. The players will win if they actually guess right the sum of the pips or an answer of whether the sum of the pips is smaller or larger than a specific point, for example 10 points.

However, the conventional ways of playing dice games are all manual and cheating can easily occur due to dishonest yet skillful players, so the conventional way of playing a die game is often unfair and controversial.

To avoid cheat occurring in a die game, a conventional die game machine is provided and substantially comprises a base, a see-through cap and a die-shaking device. Multiple dice are held inside the see-through cap and shaken by the die-shaking device. The players can directly watch the dice through the see-through cap, such that cheating is avoided. However, because the players can watch the dice directly through the see-through cap, predicting numbers and placing stakes must be done before shaking the dice. The conventional die game machine cannot provide the players a fun of guessing the pips on the dice after shaking the dice, so to play a die game with a conventional die game machine is monotonous.

To overcome the shortcomings, the present invention tends to provide a method and a machine for playing a die game to mitigate or obviate the aforementioned problems.

SUMMARY OF THE INVENTION

The main objective of the invention is to provide a method and a machine to automatically and fairly process a die game.

The method of playing a die game comprises the acts of:

operating a die game machine, wherein the die game comprises a central control device, a die-shaking device electrically connected to the central control device and having an opaque cap, a detecting device facing the shaking device and electrically connected to the central control device and multiple player-interfaces electrically connected to the central control device and each having a display;

shaking multiple dice by the die-shaking device in the opaque cap of the die game machine;

recognizing pips on the dice with the detecting device on the die game machine;

predicting numbers and placing stakes by players through the player-interfaces on the die game machine;

calculating scores of the players by the central control device;

revealing the pips on the dice to the players by removing the opaque cap; and showing the scores of the players on the displays of the player-interfaces.

The die game machine for the method has a base, a central control device, a die-shaking device, a detecting device and multiple player-interfaces. The central control device is mounted in the base. The die-shaking device is mounted in the base and is electrically connected to the central control device to shake multiple dice. The detecting device corresponds to the die-shaking device and is electrically central control device to recognize pips on the dice. The player interfaces are mounted on the base and are electrically connected to the central control device.

Other objects, advantages and novel features of the invention will become more apparent from the following detailed description when taken in conjunction with the accompanying drawings.

BRIEF OF DESCRIPTION OF THE DRAWINGS

DETAILED DESCRIPTION OF PREFERRED EMBODIMENT

Figure 1:
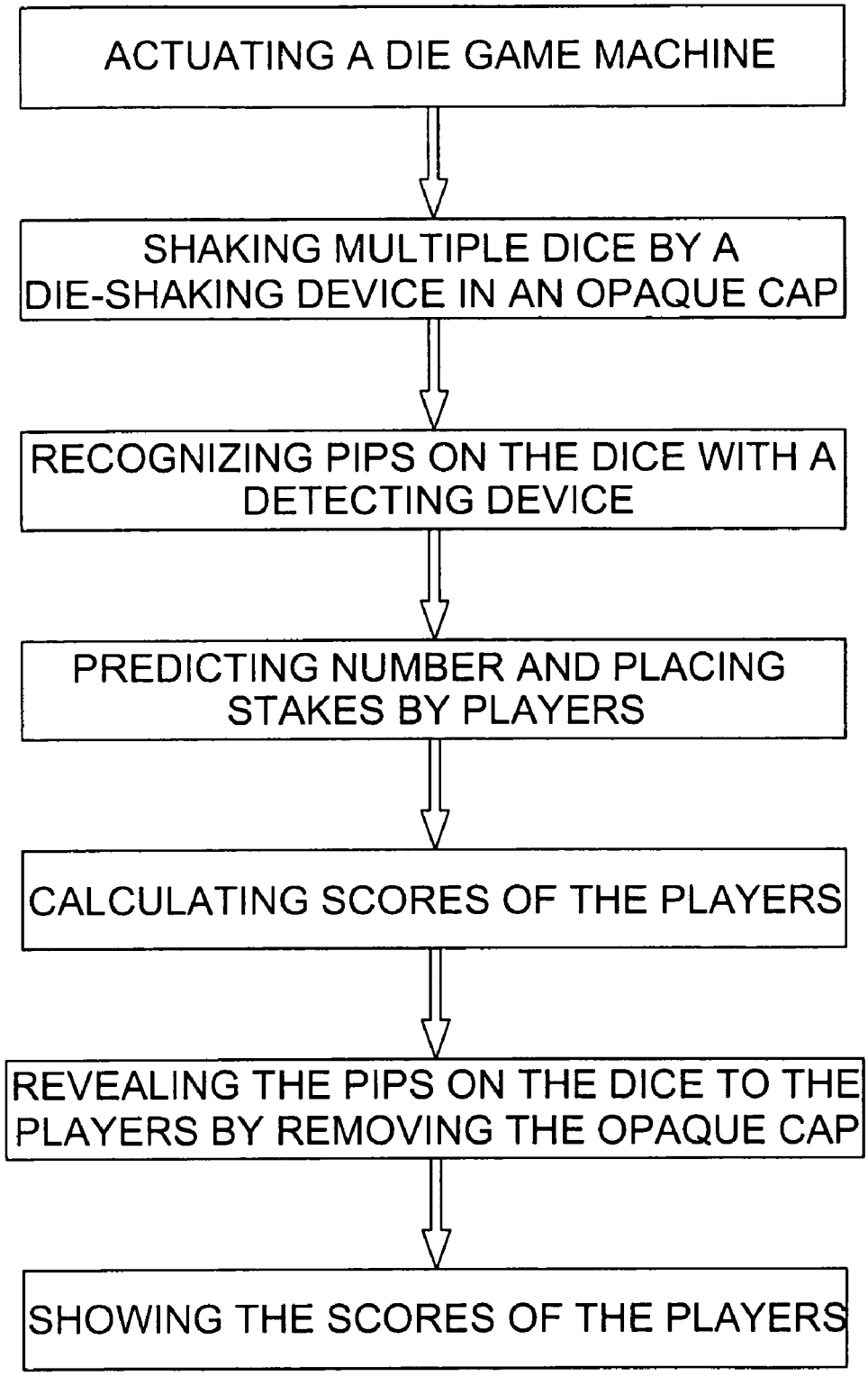
FIG. 1 is a block diagram of a method of playing a die game in accordance with the present invention.

With reference to FIGS. 1 to 4, a method of playing a die game, such as a Sic-Bo dice game, comprising acts of:

(1) Actuating a die game machine. The die game comprises a central control device (11), a die-shaking device (20), a detecting device (30) and multiple player-interfaces (40). The die-shaking device (20) is electrically connected to the central control device (11) and has an opaque cap (24). The detecting device (30) corresponds to the die-shaking device (20) and is electrically connected to the central control device (11). The multiple player-interfaces (40) are electrically connected to the central control device (11) and each has a display (41).

(2) Shaking multiple dice (50), for a Sic-Bo game, three dice (50), by the die-shaking device (20) in the opaque cap (24) of the die game machine. To achieve the conventional way of playing a Sic-Bo dice game, the dice (50) are shaken up and down three times by the die-shaking device (20).

(3) Recognizing pips on the dice (50), i.e., always pips on the topmost faces of the dice (50), with the detecting device (30) on the die game machine. If the detecting device (30) detects that any one of the dice (50) is in a irregular condition, for example any one die (50) is broken or leans against another die, the detecting device (30) will send a signal to the central control device (11) or an alarm to the players.

(4) Predicting numbers and placing stakes by players through the player-interfaces (40) on the die game machine.

(5) Calculating by the central control device (11) scores of the players.

(6) Revealing the pips on the dice to the players by removing the opaque cap (42).

(7) Showing the scores of the players on the displays (41) of the player interfaces (40).

With the method in accordance with the present invention, the die game is automatically processing with a die game machine but not manual, so the die game playing with the method is fair and not controversial. In addition, because the dice (50) are shaken in an opaque cap (42) and the players predict numbers and place stakes after shaking the dice (50), a fun of guessing pips on the dice (50) can be provided. Therefore, to play a die game with the method in accordance with the present invention is funny.

Figure 2:
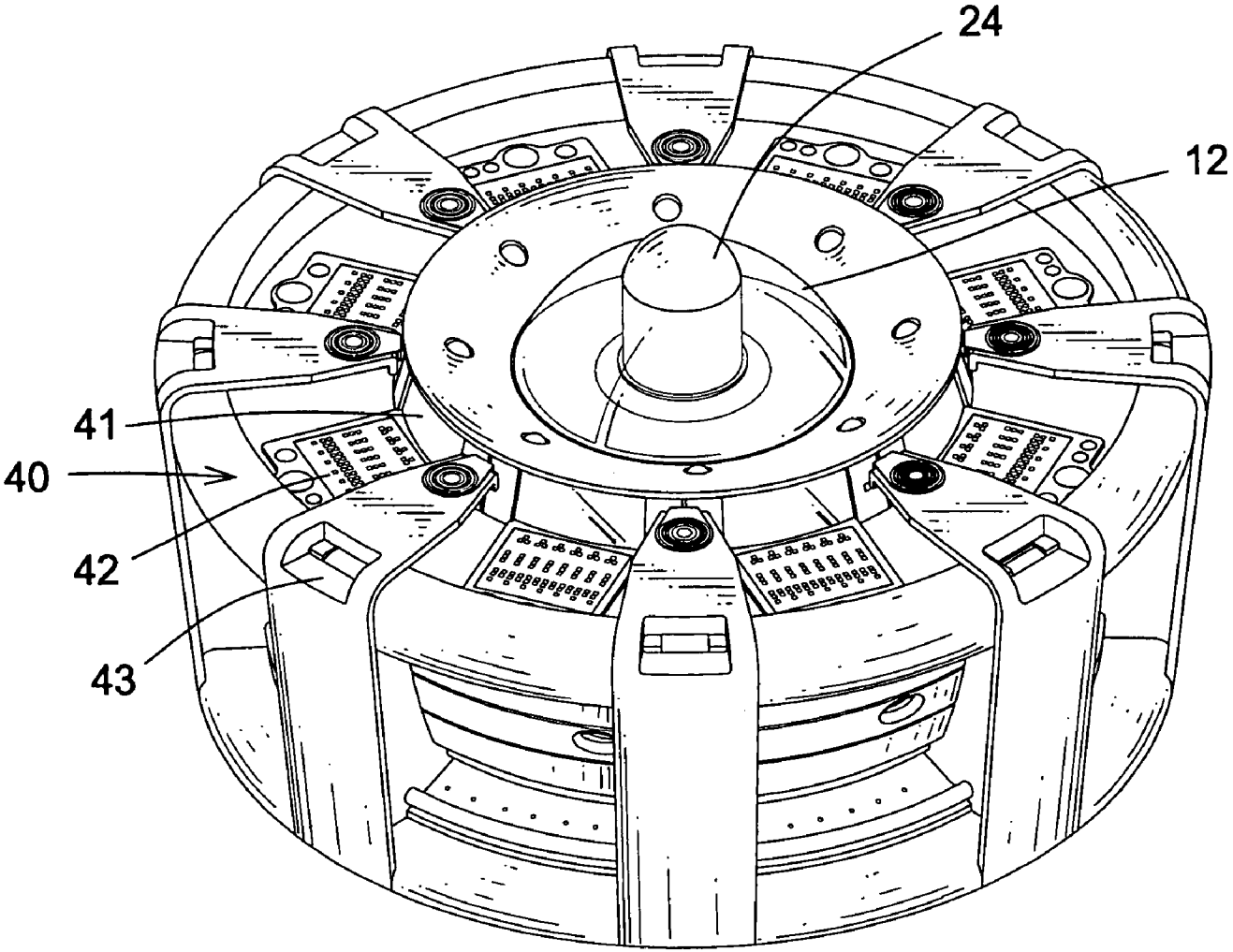
FIG. 2 is a perspective view of a machine for playing a die game in accordance with the present invention.
Figure 3:
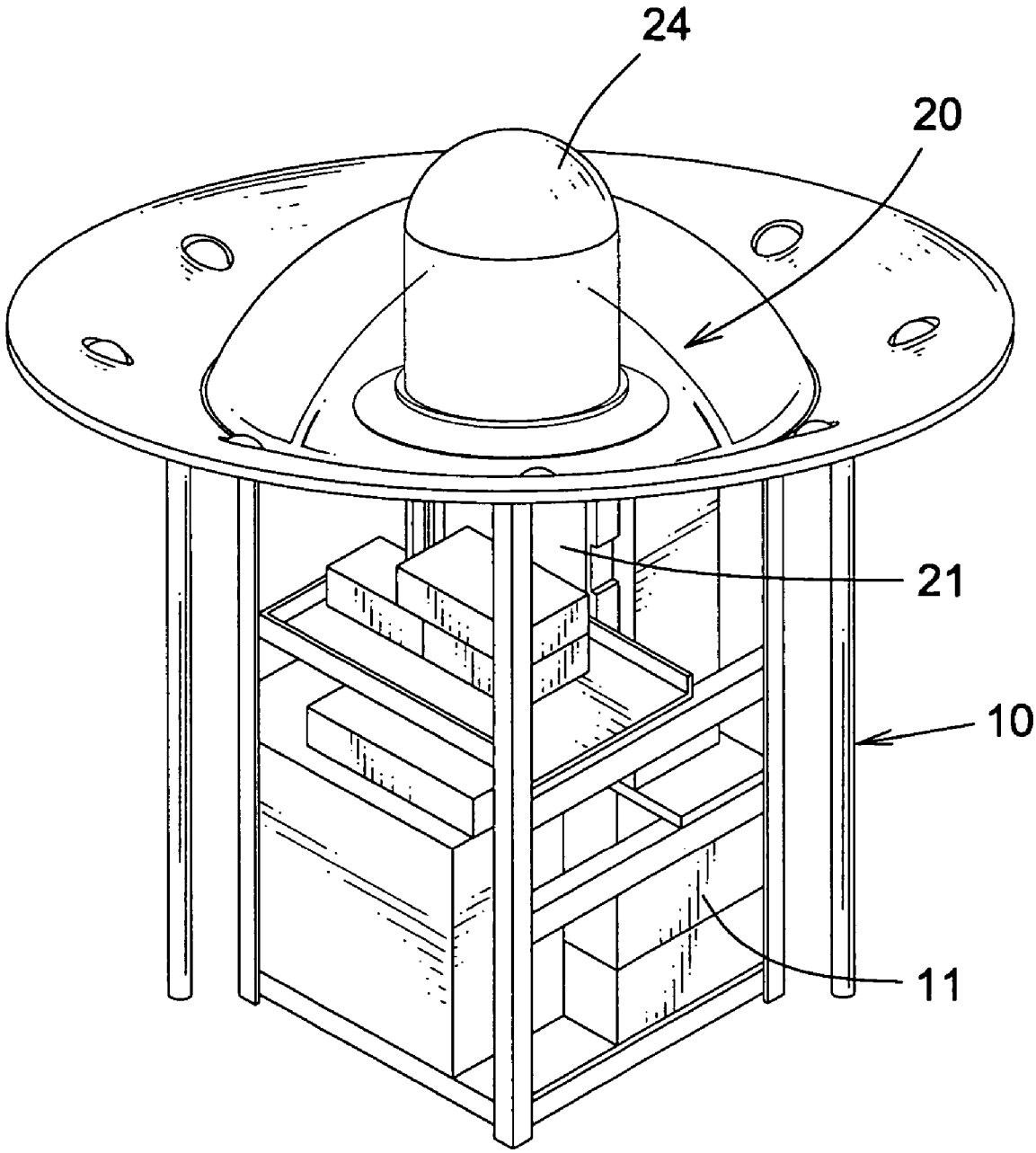
FIG. 3 is a perspective view of a base and a die-shaking device of the machine in FIG. 2.
Figure 4:
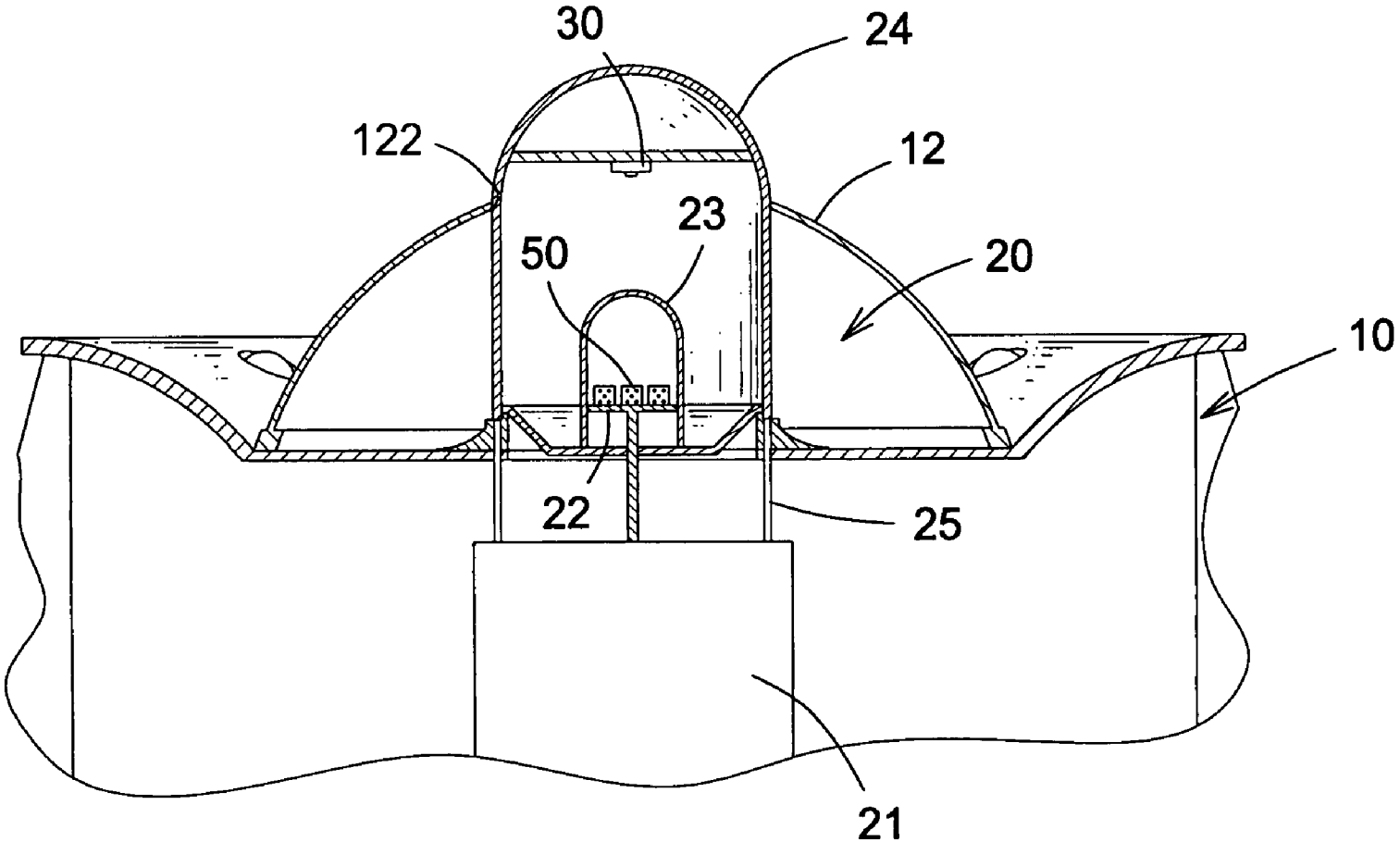
FIG. 4 is a side plan view in partial cross section of the die-shaking device of the machine in FIG. 2.

With reference to FIGS. 2 to 4, a die game machine in accordance with the present invention comprises a base (10), the central control device (11), the die-shaking device (20), the detecting device (30) and multiple player-interfaces (40). A see-through dome (12) is mounted on the top of the base (10) and a through hole (122) is defined through the top of the dome (12).

The central control device (11) is mounted in the base (10) and may have a microprocessor, a data base and computer programs.

The die-shaking device (20) is mounted on the base (10) and is electrically connected to the central control device (11). The die-shaking device (20) comprises a shaker (21), a platform (22), a see-through inner cap (23), an opaque outer cap (24) and an elevating device (25). The shaker (21) is mounted in the base (10) and corresponds to the dome (12). In an optional embodiment, the shaker (21) may comprise a driver, a transmission device and a shaft. The driver can be a motor or a pneumatic or hydraulic cylinder. The transmission device is connected between the driver and the shaft to make the shaft move up and down. The transmission device may be a cam, a lever assembly or the like. The shaft is connected to the transmission device and attached to the platform (22) to shake the platform (22) when the driver is switched on.

The inner cap (23) is made of a see-through material and is mounted on the top of the base (10) inside the dome (12). The platform (22) is mounted inside the inner cap (23) to hold dice (50) and is connected to the shaker (21), especially attached to the shaft of the shaker (21). Accordingly, when the driver of the shaker (21) is switched on, the shaft of the shaker (21) will move up and down to shake the dice (50) on the platform (22).

The opaque outer cap (24) is moveably mounted on the top of the base (10) and is mounted over and encloses the inner cap (23). The outer cap (24) has a top extending through the through hole (122) in the dome (12).

Figure 5:
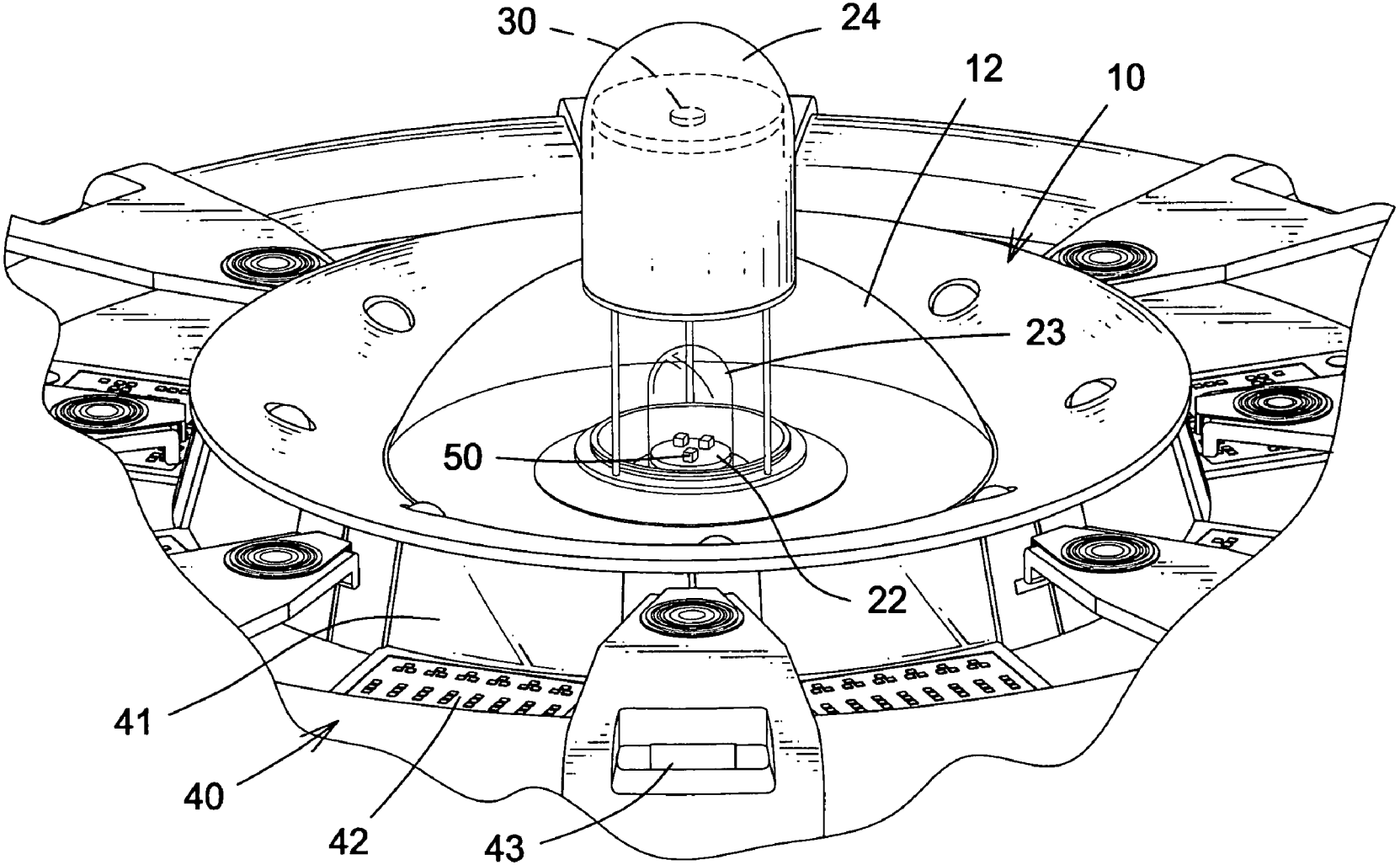
FIG. 5 is an enlarged perspective view of the machine in FIG. 2 showing that the opaque cap of the die-shaking device is removed to reveal the dice.

The elevating device (25) is mounted in the base (10) and is connected to the outer cap (24) to elevate the outer cap (24). In an optional embodiment, the elevating device (25) may comprise multiple pneumatic or hydraulic cylinders to support the outer cap (24). When the elevating device (25) is actuated, with further reference to FIG. 5, the opaque outer cap (25) will be lifted up to extend out from the through hole (122) in the dome (12), and the see-through inner cap (23) is exposed to enable players to see the pips on the dice (50).

The detecting device (30) is electrically connected to the central control device (11) and corresponds to the die-shaking device (20) to detect pips on the dice (50) enclosed in the inner cap (23). In a preferred embodiment, the detecting device (30) is attached to the inner surface of the outer cap (24), and may be a camera. When the detecting device (30) takes the images of the pips on the dice (50) and sends the images to the central control device (11), an image-recognizing program set up in the central control device (11) recognizes the images of the pips.

The player-interfaces (40) are mounted on the top of the base (10) around the dome (12) and are electrically connected to the central control device (11). Each player-interface (40) has a keyboard (42) with multiple keys to allow a player to input numbers or information. Each player interface (40) further has a display (41) to show information, such as input number, pips on the dice or a player's score to the player. In a preferred embodiment, the players can input numbers or place stakes by means of touch the displays (41) of the player interfaces (40). In addition, each player-interface (40) may further have a card/disk reading and writing device (43) to read or record information from or to a card or a disk.

With such a die game machine, a die game can be automatically processed and no person can touch or control the dice (50). Therefore, a die game is not manual and is fair to all players, even to a game banker.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method of playing a die game comprising acts of: actuating a die game machine, wherein the die game comprises a central control device, an electro-mechanical die-shaking device electrically connected to the central control device and having an opaque cap, a detecting device facing the die-shaking device and electrically connected to the central control device and multiple player-interfaces electrically connected to the central control device and each having a display;

shaking multiple dice by the die-shaking device in the opaque cap of the die game machine; wherein the method further comprises an act of recognizing pips on the dice with the detecting device on the die game machine before the act of predicting numbers and placing stakes by the players;

predicting numbers and placing stakes by players through the player-interfaces on the die game machine;

calculating scores of the players by the central control device; revealing the pips on the dice to the players by removing the opaque cap; and showing the scores of the players on the displays of the player-interfaces.

2. The method as claimed in claim 1, wherein the act of shaking the dice is shaking the dice up and down three times by the die-shaking device.

* * * * *